United States Patent [19]

Meier

[11] 4,297,956

[45] Nov. 3, 1981

[54] ZIGZAG SEWING MACHINE HAVING BASE-MOUNTED OPERATING ELEMENTS FOR CONTROLLING SEWING

[75] Inventor: Willi Meier, Karlsruhe-Durlach, Fed. Rep. of Germany

[73] Assignee: Dorina Nähmaschinen GmbH, Fed. Rep. of Germany

[21] Appl. No.: 73,635

[22] Filed: Sep. 10, 1979

[30] Foreign Application Priority Data

Sep. 14, 1978 [DE] Fed. Rep. of Germany ..... 2839963
Sep. 15, 1978 [DE] Fed. Rep. of Germany ..... 2840209

[51] Int. Cl.[3] ..... D05B 3/02
[52] U.S. Cl. ..... 112/158 A; 112/158 D
[58] Field of Search ..... 112/158 A, 158 D, 158 E, 112/158 B, 158 C, 158 R

[56] References Cited

U.S. PATENT DOCUMENTS 3,257,980 6/1966 Koike ..... 112/158 D
3,279,402 10/1966 Eguchi ..... 112/158 D
3,356,051 12/1967 Eguchi ..... 112/158 D
4,066,029 1/1978 Suchsland et al. ..... 112/158 E

FOREIGN PATENT DOCUMENTS 2735428 2/1978 Fed. Rep. of Germany ... 112/158 E

*Primary Examiner*—Peter P. Nerbun
*Attorney, Agent, or Firm*—McGlew and Tuttle

[57] ABSTRACT

A zigzag sewing machine for sewing fabric, comprises, a sewing machine housing which has a base portion which underlies an upper arm portion which is supported on a column extending upwardly from the base portion. A needle bar pendulum is mounted in the upper arm for swinging back and forth motion and a needle bar is mounted therein for upward and downward motion. A feed mechanism is located in the base portion below the upper arm and it includes a movable fabric support which is engageable with the workpiece to move it selectively in either a forward or backward direction. The drive mechanism for driving the feed mechanism and for controlling the swinging movement of the needle bar is contained in the base portion and it is operated under the control of a plurality of control cams by an operating element which is moved by depressing a key in a wall of the base portion so as to vary the type of stitch pattern which is effected.

8 Claims, 6 Drawing Figures

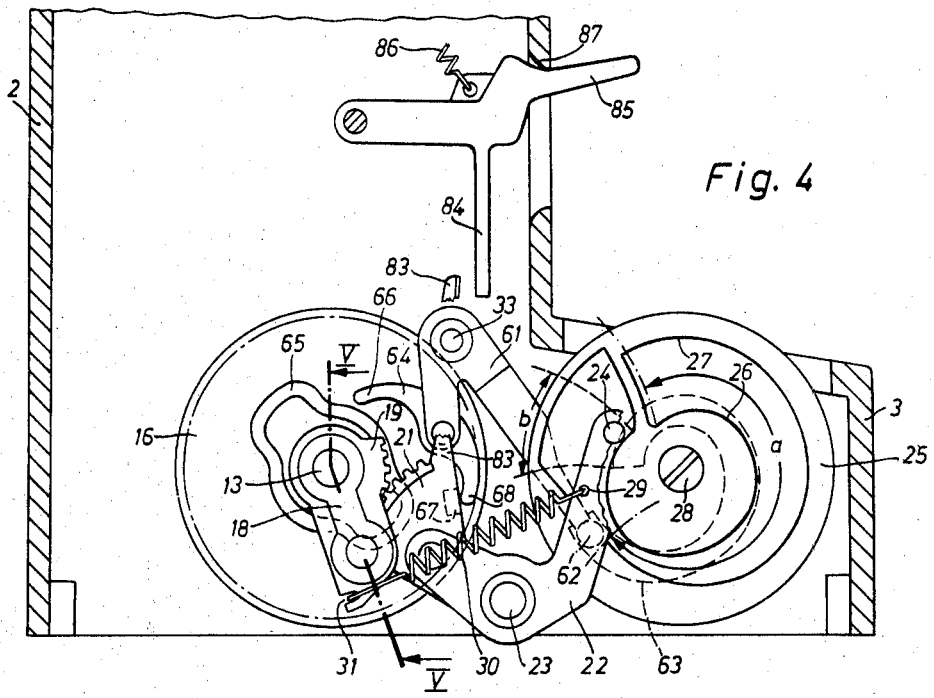
Fig. 4
Fig. 6
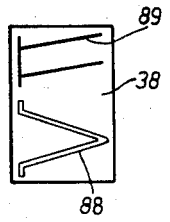
Fig. 5
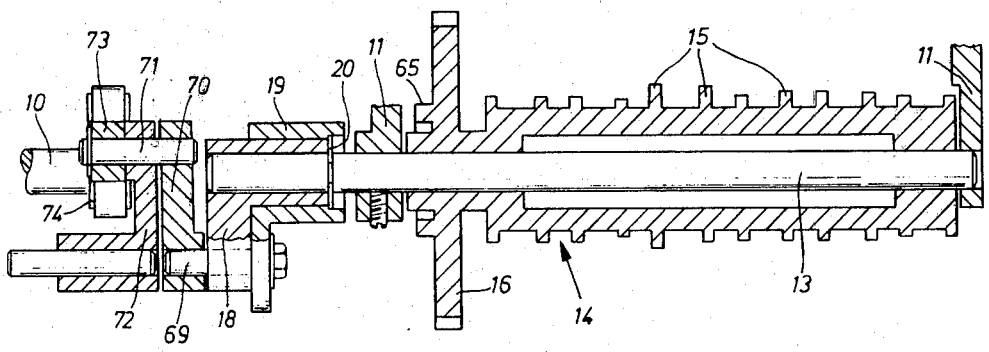

ZIGZAG SEWING MACHINE HAVING BASE-MOUNTED OPERATING ELEMENTS FOR CONTROLLING SEWING

FIELD AND BACKGROUND OF THE INVENTION

This invention relates to sewing machines in general and, in particular, to a new and useful sewing machine having a base with a widened portion defining a console panel having a plurality of operating elements and a selector which may be manipulated for the purpose of varying the zigzag stitch pattern.

DESCRIPTION OF THE PRIOR ART

In the known arrangements of zigzag sewing machines, the control cams and the associated scanning and selecting devices are mounted in the upper arm, (See U.S. Pat. No. 2,999,471), or in the column (See U.S. Pat. No. 3,257,980) of the machine, since more room is available there for the rather voluminous unit. Consequently, the machine's center of gravity is put even higher, further away from the machine's supporting surface due to the great mass of the cam plate and selector assembly, resulting in undesirable vibrations during the operation of the machine.

In addition, the transmission of the control power effecting the motion of the fabric transport and needle bar pendulum must each be accomplished by a shift linkage. Since the positioning forces are very great, in order to keep the fabric transport in its set position, considering the strong thrust forces which attack it during its feeding motion, the transmission elements between the fabric transport and the control cams must be of a rugged design. Due to the great inertial forces away from the center of gravity of the machine, undesired vibrations occur at high speeds. In addition, the backlash existing in the transmission joints causes a severe total bearing slack, impairing the precise control positions of the setting device for the fabric transport.

SUMMARY OF THE INVENTION

The present invention provides a device which avoids the disadvantages mentioned heretofore and creates a simple production engineeringwise, and favorable assemblywise, a feeding and/or overstitch control unit whose control cams and selector can be housed in the area of the machine's center of gravity.

In accordance with the invention, a zigzag sewing machine is provided with a multiplicity of scannable control cams which singly or severally together are connectable to transmission elements for the adjustment of the overstitch width of the needle bar and/or the feed direction of the fabric transport by means of a selector which contains operating elements which are connected to the control cams and the transmission elements. The control cams and the selector are mounted in brackets installed in the base of the sewing machine and the sewing machine base is provided with openings for operating elements of the selector.

This measure results in a displacement of the center of gravity towards the supporting surface of the machine and, thus, in an improvement of the machine's stability. The control cams and the selector are expediently mounted on a common support.

The openings for the operating elements, which are designed in the form of keys to pass through, are advantageously disposed on top of the widening in a sewing machine equipped with a forwardly directed widening of the base relative to the housing. This causes the pressure exerted on the keys to act in the direction toward the supporting surface of the machine, thus avoiding the application of a tilting moment on the machine which automatically originates when keys, disposed in the hitherto known manner in the front of the upper arm, are actuated. In this arrangement, the visibility of the keys is maintained completely intact.

In order to obtain a particularly compact design of the control unit, it is designed so that a positioning member for the control of the feed direction of the fabric is mounted coaxial to the control cams. This makes it possible, in addition, to dispose the positioning member in the immediate vicinity of the setting device for the feed and feed direction, thus accommodating the control unit in the lower part of the machine, and thereby, eliminating the transmission linkage between the control unit and this setting device, which is otherwise required in a rugged design because of the great forces involved. While the transmission linkage to the needle bar pendulum must be made longer, it can remain small in its mass because very little force is required to move the needle bar pendulum.

An advantageous construction for manually setting the positioning member for the feed operation and for the feed control of the fabric transport is effected by an arrangement in which the positioning member is pivoted on the shaft of the control cam and supports a gear segment which meshes with a gear segment mounted on a shaft which is parallel to the shaft of the control cam and is connected to a stop which projects between two inverse positioning cams of a setting disc.

A further favorable solution results from a construction in which a spring pushes the stop against the positioning cam for the forward stitch; that another spring attacks at two points of the engagement which are provided in a drive connection between the positioning member and the stop and which move in the same direction during the shifting motion which has a spacing therebetween which changes furing the shifting.

Through this measure, the spring length is changed much less when shifting the setting device for the feed and feed direction than in the known arrangements, in which one spring end is fastened to the sewing machine housing. For this reason, sewing machines capable of greater stitch lengths can be designed without significantly increasing the force the operator must apply to switch to back-stitching.

In accordance with the invention, there is provided a zigzag sewing machine for sewing fabric, which comprises, a housing having a base portion, a column portion extending upwardly from the base portion and an upper arm portion overlying a portion of the base portion and being connected to the top of the column portion. A needle bar pendulum is mounted in the upper arm portion for swinging back and forth motion and it has a needle bar which is mounted therein for upward and downward motion. A feed mechanism is located in the base below the needle and includes a movable fabric support which is movable for engaging and moving the fabric selectively in forward and opposite reverse directions. The construction includes drive means in the housing connected to the needle bar pendulum and the needle for reciprocating the needle and for moving the needle bar pendulum in a swinging movement of controlled magnitude and rate and also for selectively advancing and retracting the fabric at a controlled rate. The drive means includes a plurality of control cams which are rotatably mounted in the base portion and an adjustable selector mechanism connected to the cams for varying their control operation and a selector member movably mounted in the housing which is exposed in the base portion for adjustment of the control cams and the associated transmission mechanism. The construction is such that the base has a plurality of operating element openings therein with operating elements projecting outwardly from each opening which may be operated so as to vary the drive means to obtain the desired needle swing fabric feed for the particular stitch pattern selected.

Accordingly, an object of the present invention is to provide a zigzag sewing machine in which the control elements for the zigzag operation are located in a base portion of the housing of the machine.

A further object of the invention is to provide a zigzag sewing machine in which the control elements include operating keys which may be depressed in a base portion for influencing the selection of the control cams for controlling either the needle swing or the fabric feed, with the control being advantageously effected by a selector which makes it possible to regulate whether the feeding will be carried out in a first form of feeding by engaging a selected mechanism with one control cam, or in a second form of feeding in which the selected mechanism is engaged with another control cam.

Another object of the present invention is to provide a zigzag sewing machine having base-mounted operating elements for controlling sewing which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 4 is a section taken along the line IV—IV of FIG. 2;

FIG. 5 is a section taken along the line V—V of FIG. 4; and

FIG. 6 is a top plan view of one of the operating elements shown in FIG. 1.

DESCRIPTION OF THE PREFERRED EMBODIMENT

Figure 1:
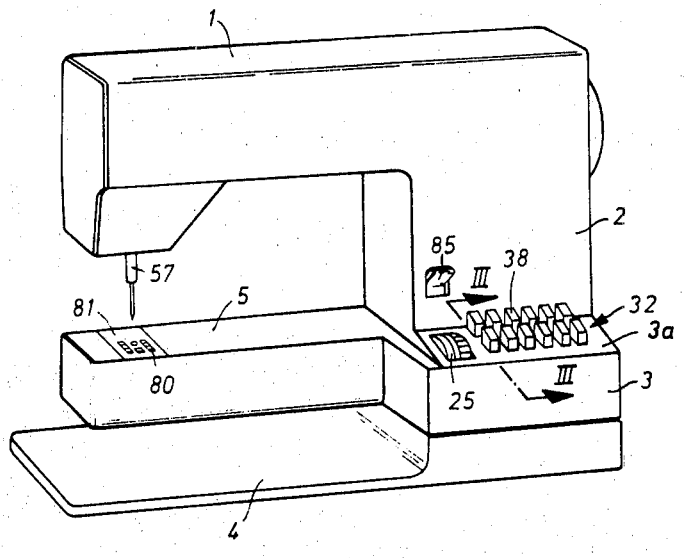
FIG. 1 is a front top perspective view of a sewing machine constructed in accordance with the present invention.

Referring to the drawings in particular, the invention embodied therein, comprises, a zigzag sewing machine for sewing fabric which comprises a sewing machine housing which includes an upper arm portion 1 mounted on the top of a column portion 2 which in turn is mounted on a base portion 3, which includes a bottom plate part 4 which underlies a fabric carrying arm 5 of the base portion 3.

In accordance with the invention, the base portion 3 is provided with a widened front part forming a console having a console top surface 3*a* with a plurality of openings therein for operating elements or keys 38 which project outwardly therefrom. In addition, the console surface 3*a* has an opening for a selector disc 25.

The fabric carrying arm is offset rearwardly with respect to the remaining portion of base 3 and the stitch-forming tools, in particular, the rotary hook of the sewing machine, is mounted in this portion. A lower shaft 10 which serves to drive the hook (not shown), in a known manner, through a gear 7 (FIG. 2) drives a toothed belt 8, a gear 9 (FIG. 3) and a main shaft 6, mounted in the machine's upper arm. A bracket 11 is fastened in the machine's base 3 (FIGS. 3 and 4) by means of screws 12.

A shaft 13 is mounted in two bearings in the bracket 11. Shaft 13 has a loosely mounted block 14, consisting of a series of control cams 15 disposed one behind the other, preceded by a gear 16. Gear 16 meshes with a gear 17 mounted on the shaft 10. The transmission ratio between gear 17 and gear 16 is 6:1. A positioning crank 18, rigidly connected to a gear segment 19, is rotatably mounted to the end of shaft 13. Positioning crank 18 is guided axially by a retaining ring 20 fastened in an annular slot in the shaft 13.

Gear segment 19 meshes with a second gear segment 21 which is fastened to an angular lever 22, mounted on a pivot pin 23, fastened in the bracket 11 and it carries a stop 24. The stop 24 projects between two positioning cams 26 and 27 formed on the one face of a setting disc 25. The setting disc 25 is mounted so as to be rotatable about a shoulder screw 28 fastened to the bracket 11. The arm of the angular lever 22 carrying the stop 24 has a point of engagement 29 to which one end of a spring 30 is hooked whose other end is hooked to a point of engagement 31 at an arm of the gear segment 19. The two points of engagement 29 and 31 are disposed on parts of the drive connection which move in the same direction. In addition, the transmission ratio of the system formed by the angular lever 22 and the gear segments 21 and 19 of the drive connection is selected so that the point of engagement 31 disposed near the positioning member 18 travels a longer distance during their common motions than the point of engagement 29. Since the spring 30 assumes its least extended position, it turns the system, so that the stop 24 contacts the inner positioning cam 26.

When the angular lever 22 and the gear segment 19 pivot, the points of engagement 29 and 31 are also pivoted. This causes the position of the effective lever arms, produced by the force of spring 30 acting on these two parts, to shift. When pivoting the stop 24 counterclockwise, the lever arm of the spring force attacking the point of engagement 29 becomes greater while the lever arm of the spring force attacking the point of engagement 31 becomes smaller. This is why the increase in tension applied to the two points of engagement 29 and 31, which occurs during this turning motion due to the extension of spring 30, can essentially be cancelled out if the location of the two points of engagement 29 and 31 is chosen so that the change in spring force caused by the shifting of the two lever arms is inversely proportional to the change in spring force effected by the transmission ratio of the drive connection between the points of engagement 29 and 31.

Figure 3:
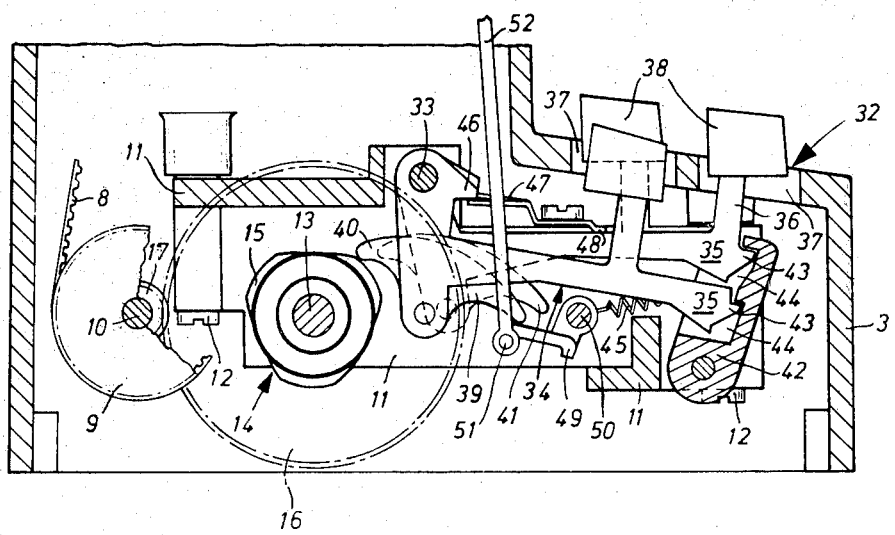
FIG. 3 is a section taken along the line III—III of FIG. 1.

A selector is installed in the bracket 11 (FIG. 3). For this purpose, a number of levers 34 matching the number of control cams 15 is suspended from a shaft 33 mounted in the bracket 11. Each of the levers 34 has a detent arm 35 and an arm 36 which projects upwardly. An operating element 38, projecting through an appropriate opening 37 in the top of the base 3 and designed as a key, is attached to each of the arms 36. A cam follower 39 having two scanners 40 and 41 is rotatably mounted to each lever 34.

The levers 34 can each be detained in two positions by a detaining rocker 42 pivoted in the bracket 11. For this purpose, their detent arms 35 have a detent 43, each of which can lock in one each of two matching depressions in the detaining rocker 42 which is pushed against the detents 43 by a spring 45. The levers 34 have shoulders 46 against which flat springs fastened to the bracket 11 support themselves. The flat springs 47 have stops 48 contacted by the raised levers 34.

The scanners 40 disposed on the one side of the cam followers 39 can interact with one each of the juxtaposed control cams 15 while the scanners 41 disposed on the other side of the cam follower 39 contact a swinging frame 49 mounted in the bracket 11 by means of a shaft 50. The swinging frame 49 is connected to a pin 51 which is engaged by a pull rod 52 connected to a needle bar pendulum 55 through a shift lever 53 (FIG. 2), hinged in the upper arm 1, and via a connecting rod 54. The needle bar pendulum 55 is hinged to a pin 56 in the upper arm 1 and carries a vertically movable needle bar 57. The bar 57 is rigidly joined to a trunnion 58 engaged by a guide rod 59 which is hinged to a crank 60 fastened to the main shaft 6.

An angular lever 61 is mounted on the shaft 33 (FIG. 4). The lever 61 has a guide pin 62 which projects into a control slot 63 in the face of the setting disc 25, opposite the face with the setting cams 26 and 27. A feeler arm 64, which has a feeler 66 pushing against a control cam 65 and a feeler 68 directed towards a stop 67 rigidly joined to the gear segment 21 is mounted to the angular lever 61. As seen in FIG. 5, the control cam 65 is rigidly joined to the gear 16.

The positioning member 18 of FIG. 5 is connected through a pin 69 to a guide rod 70 hinged by means of a pin 71 to another guide rod 72. Pin 71 is engaged by an eccentric rod 73 encompassing an eccentric 74 mounted on the shaft 10.

Figure 2:
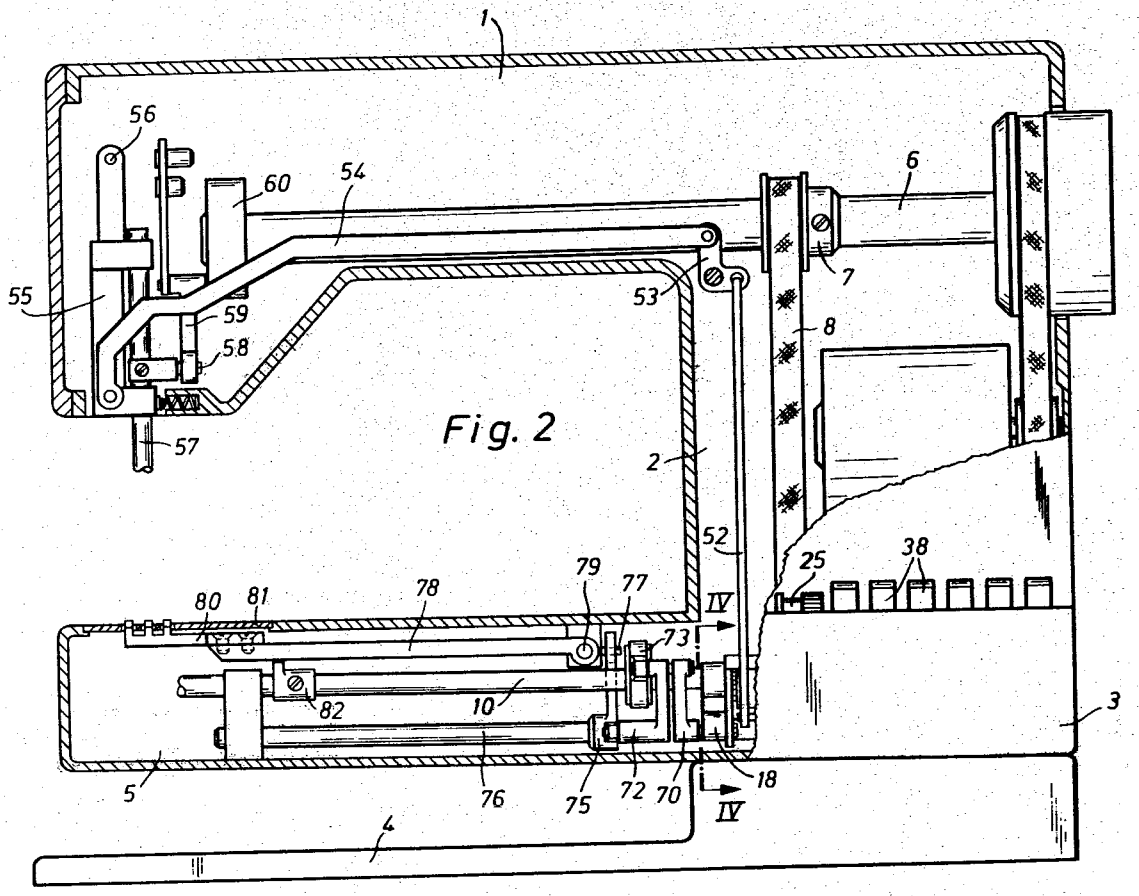
FIG. 2 is a transverse sectional view, partly in elevation, of the sewing machine shown in FIG. 1.

The guide rod 72 of FIG. 2 is connected to one arm of an angular lever 75 fastened to a shaft 76 mounted in the fabric carrying arm 5. Another arm of the angular lever 75, projecting upwardly, has a guide slot at its end, in which a pin 77 is guided. The pin 77 is fastened to a carrying arm 78 which is movably mounted on a horizontal shaft 79 fastened in the fabric carrying arm 5 parallel to the feed direction. The carrying arm 78 supports a fabric transport 80 at its free end, whose teeth act upon the fabric being sewn through slots in a stitch plate 81. The carrying arm 78 supports itself on a lifting cam 82 fastened to the shaft 10.

A lever arm 83 which projects upwardly into the path of an arm 84 of an operating lever 85 and interacts therewith to reverse the feed direction to backstitching, is fastened to the gear segment 21 (FIG. 4).

The operating lever 85 is mounted in the column 2 of the machine and is braced against an upper stop 87 by a spring 86 anchored to it and to the column 2.

In a setting range a, the positioning cams 26 and 27 provided on the setting disc 25 are designed inverse to each other, i.e., the feeds settable by it in forward and reverse directions are each the same in size. In this range, the inner positioning cam 26 serves to set the feed in a feeding direction, with the stop 24 normally resting against it. The positioning cam 27 serves the purpose of switching the feed direction to reverse by moving the stop 24 against the cam.

In the setting range b, the positioning cams 26 and 27 are designed so that the feed can be changed from a minimum to a maximum by the positioning cam 26, while the positioning cam 26 is outside of the normal range of motion of stop 24.

The operating elements 38 (FIG. 6) each carry two symbols 88 and 89 of sewing patterns which can be selected after the actuation of the respective operating element 38. In order to differentiate between the two symbols 88 and 89 defined on each operating element 38, the symbols can be of different color.

The sewing machine operates in the following manner:

When the main shaft 6 of FIG. 2 revolves, the shaft 10, driven via the gears 7 and 9 and the toothed belt 8, revolves at the same speed as the main shaft 6. The shaft 10 drives the block 14 mounted on the shaft 13 at a 6:1 transmission ratio through the gears 17 (FIG. 3) and 16, The eccentric 74 (FIGS. 2 and 5) which pivots the angular lever 75 via the eccentric rod 73 and the guide rod 72 co-rotates with the shaft 10, with guide rod 72 thereby imparting translatory motions to the carrying arm 78 and, thus, also to the fabric transport 80.

The lifting motion of the fabric transport 80 by the lifting cam 82 fastened to shaft 10 takes place in harmony with the translatory motion, in which the teeth of the fabric transport 80 rise above the surface of the stitch plate 81, engaging the material being sewn.

The setting of the size of the feeding steps by the fabric transport 80 is accomplished by moving setting disc 25 (FIG. 4), if the stop is within the adjustment range a of the positioning cams 26 and 27. The stop 24 rests against the inner positioning cam 26 under the influence of the spring 30 and moves the positioning member 18 through the angular lever 22 and the two gear segments 21 and 19, with the pin 69 serving as a pivot pin for the guide rod 70 (FIGS. 3 and 5). During the swing-out motion of the pin 71 due to the eccentric rod 73, therefore, the guide rod 70 performs a relative motion around its hinge point on the angular lever 75, in addition to this rotary motion. This relative motion is transmitted as a translatory motion to the carrying arm 78 via the angular lever 75. The carrying arm 78 slides back and forth on the shaft 79, thereby imparting translatory motions to the fabric transport 80 fastened to its free end, the size of which depends on the setting of the set screw 25.

Reversing the fabric transport 80 to back-stitching is accomplished by depressing the operating lever 85 (FIG. 4) against the pull of spring 86. The arm then pivots the lever arm 83 counterclockwise in FIG. 4 so that the gear segment 21 connected to the arm 84 pivots the angular lever 22 until the stop 24 contacts the positioning cam 27. At the same time, the positioning member 18 is pivoted by the gear segment 19 into its position intended for sewing backwards.

Upon the release of the operating lever 85, the positioning member 18 and the stop 24 return into their previous positions under the influence of spring 30, and the operating lever 85 contacts the stop 87.

The deflection amplitude of the needle bar pendulum 55 is controlled by actuating one of the operating elements 38 (FIG. 3). When depressing an operating element 38, the associated lever 34 is pivoted down and its detent 43 locks in the lower depression 44 of the detaining rocker 42. During the pivoting motion of the detaining rocker 42 occurring thereby against the pull of spring 45, a lever 34 previously detained in the depression 44 is pushed upwardly by the associated flat spring 47 against the stop 48 of elastic design for noise suppression. The detent 43 of lever 34 freely enters the upper depression 44.

Due to the motion of the actuated lever 34 into its lower position, the cam follower 39 which is hinged to it is caused to contact the associated control cam 15 and the swinging frame 49. Therefore, as the block 14 revolves, the selected control cam 15 pivots the swinging frame 49 via the associated cam follower 39, with the swinging frame 49 thereby deflecting the needle bar pendulum 55 in accordance with the contour of the selected control cam 15 via the pin 51 connected to the swinging frame 49, the pull rod 52 and the connecting rod 54. This causes the sewing machine to sew a sewing pattern corresponding to the lower symbol 88 on the operating element 38 of the depressed lever 34.

When shifting the setting disc 25 into the range in which the stop 24 is in the adjustment range b, resting against the inner positioning cam 26, the positioning cam 25 pivots the angular lever 61 through the guide pin 62 engaging its control slot 63 so that the scanner 68 of the cam follower 64 rests against the stop 67 of the gear segment 21 and its scanner 66 against the control cam 65, on the gear 61.

As the block 14 is driven, the control cam 65, in addition to the selected control cam 15, which causes the lateral deflection of the needle bar pendulum 55, now controls the motion of the positioning member 18 via the cam follower 64, the stop 67 and the gear segments 21 and 19. The deflections of the positioning member 18, in a manner already described, influence the feed and feed direction of the fabric transport 80. The design of the control cam 65 is such that the fabric transport 80 performs two feed steps in a forward direction and one subsequent feed step in a reverse direction. Due to this combined control of the needle bar pendulum 55 and fabric transport 80, the sewing machine sews a sewing pattern corresponding to the upper symbol 89 on the operating element 38 of the depressed lever 34.

The two basic colors of the symbols 88 have also been used to letter the setting disc 25 for the selection of the two setting ranges a and b so that the setting disc 25 can be set unmistakably to the desired one of the two symbols 88 or 89 of the selected operating element 38.

Either all or some of the control cams 15 may also be connected, in a manner known per se, to the positioning crank 18 for the control of the feed motion of the fabric transport 80 instead of to the needle bar 57, by means of transmission elements provided between the control cams 15 and the positioning crank 18, which is designed analogous to the described arrangement between the control cams 15 and the swinging frame 49. Of course, the contour of these control cams 15 must then be adapted to the feed and feed direction of the fabric transport 80 to be controlled. By appropriately selecting the operating elements 38 of the selector 32, an automatic control of the lateral deflecting motion of the needle bar 57 only or of the feeding motion of the fabric transport 80 only, or else the joint control of both the needle bar 57 and the fabric transport 80 can then be actuated.

In the zigzag sewing machine of the present invention, with a multiplicity of control cams 15 and 65, the cams are connectable by a selector 32 to transmission elements for the adjustment of the overstitch width of the needle bar 57 and/or of the fabric transport 80. To favorably place the machine's center of gravity, the control cams 15 and 65 and the selector 32 are mounted to one common bracket 11 which is fastened in the base of the machine. In order to achieve a compact and simple design of the control unit, the positioning member 18 for the control of the feed and feed direction of the fabric transport 80 is mounted coaxial to the control cams 15 and 65.

While a specific embodiment of the invention has been shown and described in detail to illustrate the application of the principles of the invention, it will be understood that the invention may be embodied otherwise without departing from such principles.

What is claimed is:

1. In a zigzag sewing machine with a multiplicity of scannable control cams which singly or severally together are connectable to transmission elements for adjusting the overstitch width or swing of the needle bar and/or of the feed direction of the fabric feed mechanism by means of a selector containing operating elements which are connected to the control cams and the transmission elements, the improvement comprising, a base portion, bracket means in said base portion mounting said control cams and said selector, said base portion having a wall with a plurality of openings therethrough, and operating elements pivotally mounted in said base portion and having a key part extending through the opening for manipulation to vary the stitch pattern, said wall also having an opening for the selector to pass through so that it may be adjusted manually.

2. In a zigzag sewing machine, the improvement according to claim 1, wherein said bracket means comprises a single bracket disposed in said base portion, said control cams and said selector being rotatably mounted on said bracket.

3. In a zigzag sewing machine, the improvement according to claim 1, wherein said sewing machine includes a base portion having a widened part with a top console wall of said widened part containing the openings for said operating elements.

4. In a zigzag sewing machine, the improvement according to claim 1, wherein said transmission elements include a rotatable setting device and a control member adapted to scan the cams having a portion engaged in said selector, and a positioning member for the control of the feed in the feed direction of the fabric transport being mounted coaxial to said control cams.

5. A zigzag sewing machine for sewing fabric, comprising, a sewing machine housing having a base portion, a column portion extending upwardly from said base portion, and an upper arm portion overlying a portion of said base portion and connected to said column, a needle bar pendulum mounted in said upper arm portion for swinging backward and forward movement, a needle bar having a needle mounted on said needle bar pendulum for upward and downward motion, a feed mechanism in said base portion below said needle and including a movable fabric support being movable for engaging and moving the fabric selectively in forward and reverse directions, drive means in said housing connected to said needle bar pendulum and to said needle bar for reciprocating said needle bar with said needle and for swinging said needle bar pendulum in a controlled magnitude of swing and rate of swing and being connected to said feed mechanism and said movable fabric support for selectively advancing and retracting the fabric at a controlled rate, said drive means including a plurality of control cams rotatably mounted in said base portion, an adjustable selector mechanism mounted in said base portion for movement, follower means connected between said cams and said adjustable selector mechanism, and an operating element mounted in said base portion and engageable with said follower mechanism for varying the follower mechanism which is engaged between said selector mechanism and said cams and including a control key part, said housing base portion having an opening through which said key part extends for manipulation to set said operating element for selectively varying the drive means through the operation of a selected one of said cams.

6. A zigzag sewing machine, according to claim 5, including a control shaft carrying said control cams, a positioning member pivoted on said control shaft, a gear segment supported by said positioning member, a parallel shaft mounted parallel to said control shaft, a second gear segment mounted on said parallel shaft and interengaged with said gear segment, said adjustable selector mechanism including a setting disc having two inverse positioning cams thereon engageable with said stop member for controlling the position of said positioning member.

7. A zigzag sewing machine, according to claim 5, including a spring having two points of engagement provided on a drive connection between the positioning member and the stop, said points being movable in the same direction during the shifting motion, having a spacing therebetween which changes during the shift.

8. A zigzag sewing machine, according to claim 7, wherein, in order to keep the resultant spring force moment constant, the effective length of lever arms of the spring changes in proportion to the length of mutual distance of the points of engagement of the spring.

* * * * *